US007434602B2

(12) United States Patent
Barone

(10) Patent No.: US 7,434,602 B2
(45) Date of Patent: Oct. 14, 2008

(54) DRIP CHAMBER DROPPER BOTTLE

(75) Inventor: Joseph Barone, Hillsborough, NJ (US)

(73) Assignee: University of Medicine & Dentistry of New Jersey, Somerset, NJ (US)

( * ) Notice: Subject to any disclaimer, the term of this patent is extended or adjusted under 35 U.S.C. 154(b) by 0 days.

(21) Appl. No.: 11/498,403

(22) Filed: Aug. 3, 2006

(65) Prior Publication Data

US 2008/0029180 A1 Feb. 7, 2008

(51) Int. Cl.
*B65B 1/04* (2006.01)
*B65D 37/00* (2006.01)

(52) U.S. Cl. ..... 141/112; 141/22; 222/209

(58) Field of Classification Search ..... 141/21–24, 141/112, 114, 387; 222/153.11, 209
See application file for complete search history.

(56) References Cited

U.S. PATENT DOCUMENTS 1,241,207 A * 9/1917 Gilbert ..... 222/341
2,756,749 A 7/1956 Munday
2,772,704 A 12/1956 McConnell et al.
2,845,963 A * 8/1958 Zackheim ..... 141/24
2,877,810 A * 3/1959 Zackheim ..... 141/24
3,060,942 A 10/1962 Finlay
3,139,121 A * 6/1964 Ballin ..... 141/24
3,312,255 A * 4/1967 Miller ..... 141/24
3,360,168 A 12/1967 Bret
4,175,597 A * 11/1979 Peterson ..... 141/23
4,470,526 A 9/1984 Cha et al.
4,694,977 A 9/1987 Graf et al.
4,969,585 A 11/1990 Hester
5,366,119 A 11/1994 Kline
5,464,048 A 11/1995 Allen
5,749,500 A 5/1998 Kraus et al.
5,782,381 A 7/1998 Woodruff et al.
6,070,768 A 6/2000 Collin et al.
RE37,675 E * 4/2002 Gueret ..... 222/153.06

* cited by examiner

*Primary Examiner*—Timothy L Maust
(74) *Attorney, Agent, or Firm*—Klauber & Jackson LLC

(57) ABSTRACT

A chamber dropper bottle is disclosed that is sized to contain medicine. The dropper bottle includes a central recess in a bottom wall of the bottle. The recess is sized to accommodate a single dose of medicine. A central tapered cylindrical dropper chamber extends into the recess, while an annular medicine chamber is positioned about the central tapered cylindrical dropper chamber. The central tapered cylindrical dropper chamber includes one or more apertures sized to allow fluid to flow between the annular medicine chamber, the central tapered cylindrical dropper chamber and the recess.

18 Claims, 1 Drawing Sheet

DRIP CHAMBER DROPPER BOTTLE

BACKGROUND OF THE INVENTION

1. Field of the Invention

The present invention relates to a dropper bottle for dispensing doses of liquid medicine.

2. Related Art

Dropper bottles are known in the art for dispensing medicine. Dropper bottles generally include a bottle for holding a substance such as a liquid medicine, and a dropper apparatus that is used in connection with the bottle. The dropper apparatus typically includes a squeezable bulb attached to a cap that threadably engages with the bottle, and a tapered cylinder that extends into the bottle. In operation, the squeezable bulb is squeezed to force air out of the tapered cylinder. The squeezable bulb is then released, sucking liquid medicine into the tapered cylinder. The dropper apparatus is then withdrawn from the bottle, placed at a location where liquid medicine is to be discharged, and the squeezable bulb is again squeezed, this time forcing the liquid medicine from the tapered cylinder.

The tapered cylinder has an aperture at the distal end, which is placed proximate to the bottom of the dropper bottle when the cap is fully engaged with the bottle. However, there is typically a gap between the distal end of the tapered cylinder and the bottom of the dropper bottle. This results in the inability to withdraw the last amount of medicine from the dropper bottle, i.e., the medicine remaining in the bottle but below the distal end of the dropper apparatus. This leads to the waste of the last dosage or dosages of medicine. Another problem associated with dropper bottles of the prior art is the inability to effectively judge whether a full dose, or a portion of a dose remains in the bottle.

SUMMARY OF THE INVENTION

The present invention relates to a chamber dropper bottle comprising a bottle portion including a central recess in a bottom wall of the bottle, a central tapered cylindrical dropper chamber extending from an upper end of the bottle to the central recess, and an annular medicine chamber about the central tapered cylindrical dropper chamber. One or more apertures at a lower edge of the central tapered cylindrical dropper chamber provide fluid communication between the annular medicine chamber, the central tapered cylindrical dropper chamber and the central recess.

In one embodiment, the dropper bottle comprises the bottom wall with a recess that is sized to correspond to a dose of medicine. The recess is substantially centrally disposed in the bottom wall. A dropper having a dropper cylinder with an apertured lower edge extends into the recess.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a drip chamber dropper bottle 10 including a bottle portion having a central recess 24 in a bottom wall 22 of the bottle 10, and a central tapered cylindrical dropper chamber 30 extending from an upper end of the bottle 10 to the central recess 24.

Figure 1:
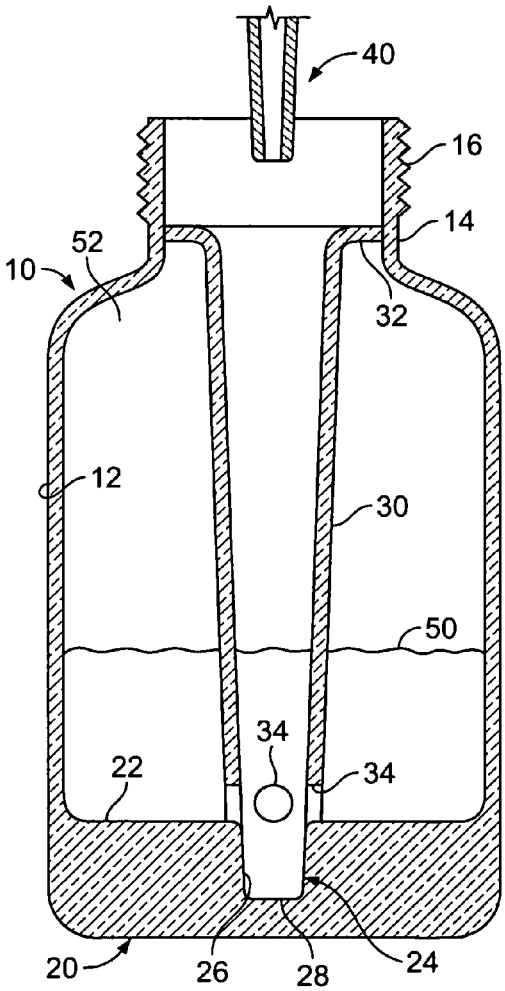
FIG. 1 is a cross-sectional view of the dropper bottle of the present invention.

Referring to FIG. 1, the drip chamber dropper bottle 10 of the present invention is shown cross-section. The bottle 10 can be sized and shaped in any desired configuration, and can be made of any desired material. As shown in FIG. 1, the bottle 10 includes an outer wall 12 defining the shape and size of the bottle 10. At an upper area of the bottle 10, the outer wall 12 is necked to throat area 14 which bears external threads 16 for engaging a dropper 40 as will be hereinafter discussed.

The lower portion of the bottle 10 comprises a base 20 which joins with the outer wall 12 along the circumference of the base 20. The base 20 has an exterior surface and an interior surface defined by the inner wall 22, and a thickness between the inner and outer surfaces. The recess 24 is formed in the base 20 and extends from the inner wall 22 into the thickness of the base 20. The recess 24 is defined by a cylindrical recess wall 26 terminating in a recess bottom wall 28.

Figure 2:
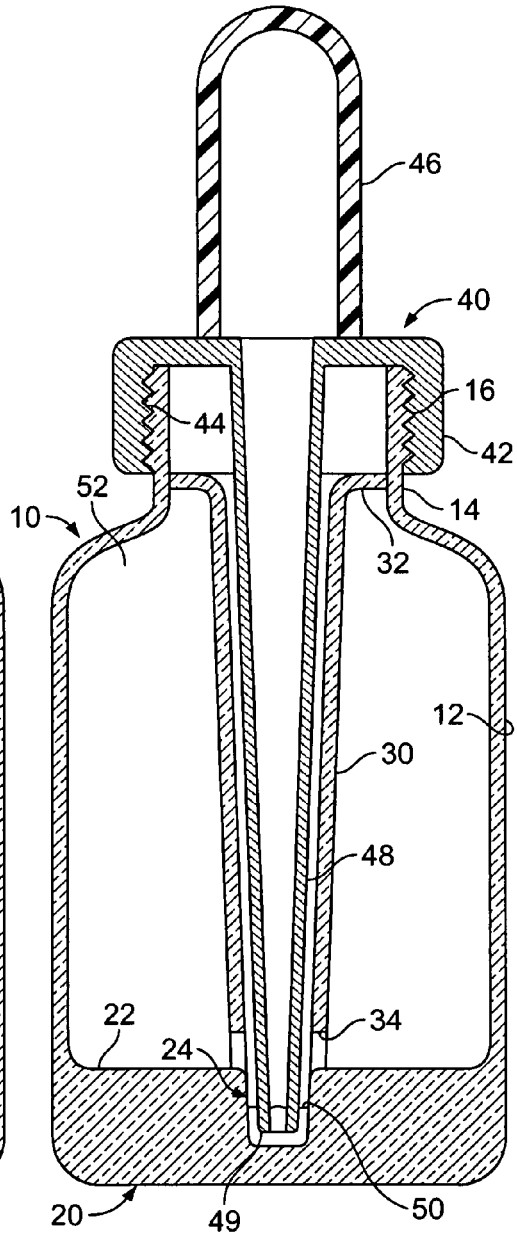
FIG. 2 is a cross-sectional view of the dropper bottle shown in FIG. 1 with the dropper fully engaged with the bottle.

Also provided within bottle 10 is a central tapered cylindrical dropper chamber 30 extending from the throat area 14 where it is engaged by an upper shoulder 32, down to the recess 24. The upper shoulder 32 has a diameter that is larger than the diameter of the lower end of the central tapered cylindrical dropper chamber 30 so as to provide the central tapered dropper chamber 30 with its tapered configuration. An annular medicine chamber 52 extends about the central tapered cylindrical dropper chamber 30. The bottom wall 22 defines the bottom of the annular medicine chamber 52. As shown in FIGS. 1 and 2, the recess 24 is formed at a level below the annular medicine chamber 52. One or more apertures 34 are provided in the central tapered cylindrical dropper chamber 30 to provide fluid communication between the dropper chamber 30 and the annular medicine chamber 52.

As can be seen in FIG. 2, the dropper 40 is inserted into and engaged with the dropper bottle 10. A dropper cap 42 is circumferentially disposed about the throat area 14 of the bottle 10 and includes internal threads 44 that engage threads 16 on the dropper bottle 10. The dropper 40 includes a squeezable bulb 46 and a dropper cylinder 48 having an apertured lower edge 49. The dropper cylinder 48 is tapered and has a shape that approximates the shape of the central tapered cylindrical dropper chamber 30. The dropper cylinder 48 fits within the central tapered cylindrical dropper chamber 30, and extends into the recess 24. To deliver a dose of medicine 50, the dropper 40 is inserted into the bottle 10, the central tapered cylindrical dropper chamber 30 guiding and positioning the dropper cylinder 48 to position the apertured lower edge 49 into the recess 24. Then, the squeezable bulb 46 is squeezed to expel air in the dropper cylinder 48 and released to suck medicine 50 into the dropper cylinder 48. Then, the dropper 40 can be removed from the bottle 10 and medicine 50 can be delivered to a desired location by positioning the dropper 40 at the desired location and squeezing the squeezable bulb 46 to expel the medicine 50. Thereafter, the dropper 40 can be repositioned within, and if desired, engaged with the bottle 10.

The recess 24 can be sized and shaped to contain a single dose of medicine 50. As the medicine 50 is removed from the recess 24 by the dropper 40, the remaining medicine 50 just fills up the recess 24. Accordingly, one can ascertain by visual inspection whether a sufficient amount of medicine 50 remains to constitute a full dose. As can be seen in FIG. 2, where the medicine 50 falls below the upper edge of the recess 24, i.e. where the medicine 50 falls below the internal bottom wall 22, one can visually ascertain that a full dose of medicine 50 does not remain. In addition to providing a visual indication of whether a full dose of medicine 50 remains in the bottle 10, the recess 24 provides for the collection of the medicine 50 and facilitates collection of the medicine 50 for withdrawal by the dropper 40. In this manner, the recess 24 facilitates the withdrawal of all of the medicine 50 from the bottle 10 by the dropper 40, including the last few drops of the medicine 50, thereby avoiding any waste.

Having thus described the invention in detail, it is to be understood that the foregoing description is merely exemplary and that a person skilled in the art may make many variations and modifications without departing from the spirit and scope of the invention. For example, the medicine 50 can be a liquid, a gel, etc. Any mechanism can be used to provide fluid communication between the central tapered cylindrical dropper chamber 30 and the annular medicine chamber 52. It should be understood that the central tapered cylindrical dropper chamber 30 is an optional feature. Any mechanism, other than the central tapered cylindrical dropper chamber 30, can be used for guiding the dropper cylinder 48 of the dropper 40 to position the apertured lower edge 49 into the recess 24. What is desired to be protected by Letters Patent is set forth in the appended claims.

What is claimed is:

1. A dropper bottle comprising:

a bottom wall having a recess;

a central tapered cylindrical dropper chamber extending internally from an upper area of the dropper bottle to the recess;

an annular medicine chamber about the central tapered cylindrical dropper chamber;

means for fluid communication between the central tapered cylindrical dropper chamber and the annular medicine chamber; and a dropper engagable with the bottle, the dropper having a dropper cylinder extending within the dropper chamber into the recess.

2. The dropper bottle of claim 1, wherein the recess is centrally disposed in the bottom wall.

3. The dropper bottle of claim 2, wherein the recess comprises a cylindrical wall and a bottom wall.

4. The dropper bottle of claim 3, wherein the means for fluid communication comprises one or more apertures in a wall of the central tapered cylindrical dropper chamber.

5. The dropper bottle of claim 1, wherein the recess is sized to correspond to a dose of medicine.

6. The dropper bottle of claim 1, wherein the bottom wall includes a solid base having an exterior surface and an interior surface, the solid base having a thickness between the exterior surface and the interior surface, the recess being formed in the solid base and extending into the thickness of the solid base.

7. The dropper bottle of claim 1, wherein the central tapered cylindrical dropper chamber has an upper end with a first diameter and a lower end with a second diameter, the first diameter of the upper end being larger than the second diameter of the lower end.

8. The dropper chamber of claim 1, wherein the dropper cylinder of the dropper is tapered.

9. The dropper chamber of claim 8, wherein the dropper cylinder of the dropper has a shape approximating the shape of the central tapered cylindrical dropper chamber.

10. The dropper chamber of claim 1, wherein the dropper has an apertured lower edge, the central tapered cylindrical dropper chamber being sized to guide the dropper cylinder so as to position the apertured lower edge into the recess.

11. The dropper chamber of claim 1, wherein the annular medicine chamber has a bottom defined by the bottom wall, the recess being formed at a level below the bottom.

12. A dropper bottle comprising:

a bottom wall having a recess sized to correspond to a dose of medicine, the recess being substantially centrally disposed in the bottom wall; and a dropper having a dropper cylinder with an apertured lower edge extending into the recess, wherein the means for guiding comprises a central tapered cylindrical dropper chamber extending internally from an upper area of the dropper bottle to the recess, the dropper chamber approximating the shape of the dropper cylinder.

13. The dropper bottle of claim 12, further comprising means for guiding the dropper cylinder to position the apertured lower edge into the recess.

14. The dropper bottle of claim 12, further comprising an annular medicine chamber about the central tapered cylindrical dropper chamber.

15. The dropper bottle of claim 12, wherein the recess is sized to correspond to a single full dose of medicine.

16. The dropper bottle of claim 12, wherein the recess comprises a cylindrical wall and a bottom wall.

17. The dropper bottle of claim 12, wherein the bottom wall includes a solid base having an exterior surface and an interior surface, the solid base having a thickness between the exterior surface and the interior surface, the recess being formed in the solid base and extending into the thickness of the solid base.

18. A dropper bottle containing medicine comprising:

a bottom wall having a recess sized to correspond to a single dose of medicine;

a dropper engagable with the bottle, the dropper having a dropper cylinder with an apertured lower edge extending into the recess; and means for guiding the dropper cylinder to position the apertured lower edge into the recess, wherein the means for guiding comprises a central tapered cylindrical dropper chamber extending internally from an upper area of the dropper bottle to the recess, the dropper chamber approximating the shape of the dropper cylinder.

* * * * *